US010144141B1

(12) United States Patent
Harrylal

(10) Patent No.: US 10,144,141 B1
(45) Date of Patent: Dec. 4, 2018

(54) STRAIGHT RAZOR WITH RELOADABLE CARTRIDGE

(71) Applicant: Kevin Harrylal, Mississauga (CA)

(72) Inventor: Kevin Harrylal, Mississauga (CA)

( * ) Notice: Subject to any disclaimer, the term of this patent is extended or adjusted under 35 U.S.C. 154(b) by 16 days.

(21) Appl. No.: 15/597,524

(22) Filed: May 17, 2017

(51) Int. Cl.
*B26B 21/10* (2006.01)
*B26B 21/40* (2006.01)

(52) U.S. Cl.
CPC ..... *B26B 21/10* (2013.01); *B26B 21/4031* (2013.01)

(58) Field of Classification Search
CPC ..... B26B 21/10; B26B 21/4031
See application file for complete search history.

(56) References Cited

U.S. PATENT DOCUMENTS 3,456,340 A * 7/1969 Mondiello ..... B26B 21/10 30/30
3,613,233 A * 10/1971 Lundell ..... B26B 21/12 30/30
3,728,788 A * 4/1973 Pearson ..... B26B 21/08 30/40.2
4,037,322 A * 7/1977 Bresler ..... B26B 21/10 30/30
4,665,615 A * 5/1987 Martinez ..... B26B 21/525 30/53
4,920,644 A * 5/1990 LaGattuta ..... B26B 21/10 30/330
5,649,364 A * 7/1997 Ilanlou ..... B26B 21/10 30/40.2
6,164,290 A * 12/2000 Andrews ..... A45D 24/36 132/215
8,806,758 B2 * 8/2014 Pineda ..... B26B 21/10 30/30
2003/0196330 A1 * 10/2003 Kitano ..... B26B 21/10 30/53

* cited by examiner

*Primary Examiner* — Sean Michalski
(74) *Attorney, Agent, or Firm* — Nasser Ashgriz; UIPatent Inc.

(57) ABSTRACT

The present invention is a straight razor used in a barber shop for housing a plurality of blades. The straight razor comprises of a handle having a handle-distal end and a handle-proximal end, wherein the handle comprises of a longitudinal body with a longitudinal slot at a top portion of the longitudinal body; a groove along a wall side of the longitudinal body to navigate a charging-handle to a pathway; a blade holder wherein the blade holder is placed inside the longitudinal slot, the blade holder is pivotally attached to the handle from the handle-proximal end, the blade holder comprises of an elongated body with two clamp members designed at a holder-distal end to grab a blade; and a reloadable cartridge having a cartridge-enclosure with a plurality of springs attached inside the cartridge-enclosure to push a plurality of blades toward a cartridge opening.

7 Claims, 11 Drawing Sheets

STRAIGHT RAZOR WITH RELOADABLE CARTRIDGE

FIELD OF THE INVENTION

The present invention relates generally to a disposable shaving blades used in barbershops, and specifically to a straight razor with reloadable cartridge.

BACKGROUND OF THE INVENTION

A disposable shaving blades used in barbershops typically comprise of a body and a razor blade, which is periodically changed while keeping the body for further use. Since the razor blades come in direct contact with ones' skin, it is required to change the blade after each use to keep the shaving process sanitary and prevent any contamination. Changing the blade of a barbershop razor is tedious and time consuming, especially when tens of shaves are performed a day.

The present invention provides a solution for the above problem to prevent contamination and also facilitate the process of changing blades in barber shops.

SUMMARY OF THE INVENTION

The present invention is a straight razor used in a barber shop, which has housing to store a plurality of blades for a quick replacement. The straight razor comprises of a handle having a handle-distal end and a handle-proximal end, wherein the handle comprises of a longitudinal body with a longitudinal slot at a top portion of the longitudinal body; a groove along a wall side of the longitudinal body to navigate a charging-handle to a pathway.

The straight razor comprises of a blade holder wherein the blade holder folds into a longitudinal slot. The blade holder is pivotally attached to the handle from the handle-proximal end. The blade holder comprises of an elongated body with two clamp members designed at a holder-distal end to grab a blade; and a reloadable cartridge having a cartridge-enclosure with a plurality of springs attached inside the cartridge-enclosure to push a plurality of blades toward a cartridge opening.

For reloading a new blade from the blades stored inside the reloadable cartridge, a user pushes the charging-handle along the groove. The charging-handle engages with the new blade and moves it from the reloadable cartridge towards the longitudinal slot between the two clamp members.

The present straight razor with reloadable cartridge allows changing several blades (i.e., five blades) automatically and without any physical contact with the used and the new blades.

The present invention has a reloadable cartridge that can hold five single edge blades. The cartridge is equipped with a spring that allows new blade to load in the head of the razor without manually touching the blade.

The head of blade in the present invention has an ejection slider that releases a used blade. A dial on the head of the razor allows the blade to be exposed for more detailed shave in a safety position so the edges of the blade are not exposed.

One objective of the present invention is to provide a razor that a barber does not have to physically touch the blade for loading and unloading. As with the existing shaving devices, one must manually place each blade into the holder for every shave and manually remove or unload. The straight razor of the present invention is fully automatic and hygienic.

Another objective of the present invention is to provide a straight razor to allow five consecutive shaves without having to load each individual blade. The straight razor of the present invention is light weight and easy to use.

Another objective of the present invention is to provide a straight razor to save time for busy barbers.

Another objective of the present invention is to provide a straight razor with an option to adjust the length of the blade for a more detailed shave.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modification and alteration, and that the disclosed technology be limited only by the claims and equivalents thereof.

DETAILED DESCRIPTION OF PREFERRED EMBODIMENTS

The device disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1A:
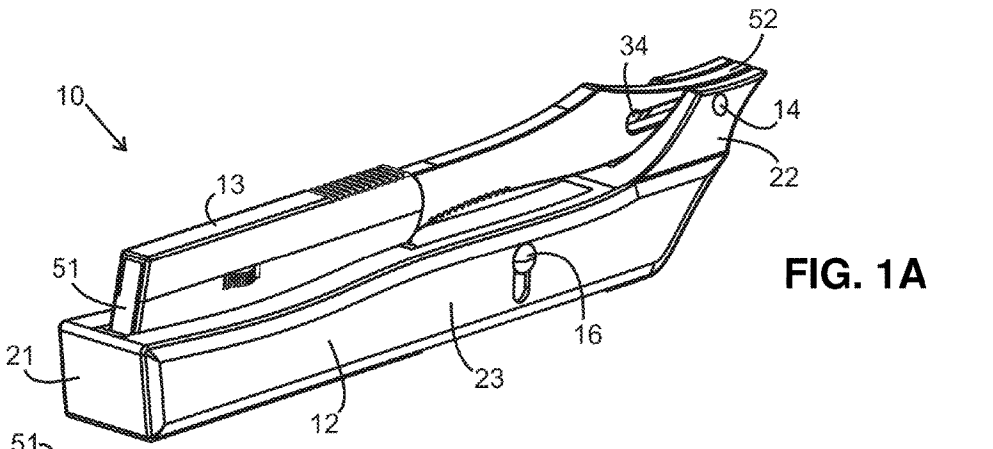
FIG. 1A shows a lateral perspective view of a straight razor with reloadable cartridge of the present invention.
Figure 1B:
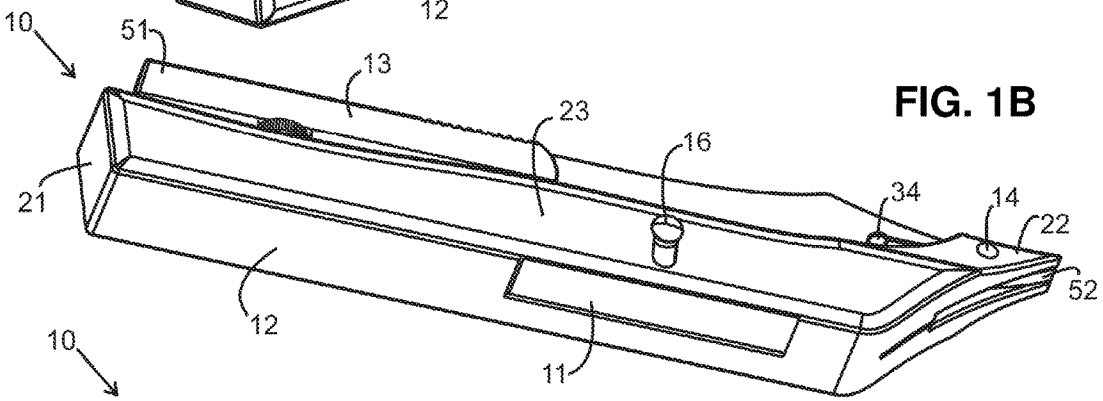
FIG. 1B shows a bottom perspective view of a straight razor with reloadable cartridge of the present invention.
Figure 1C:
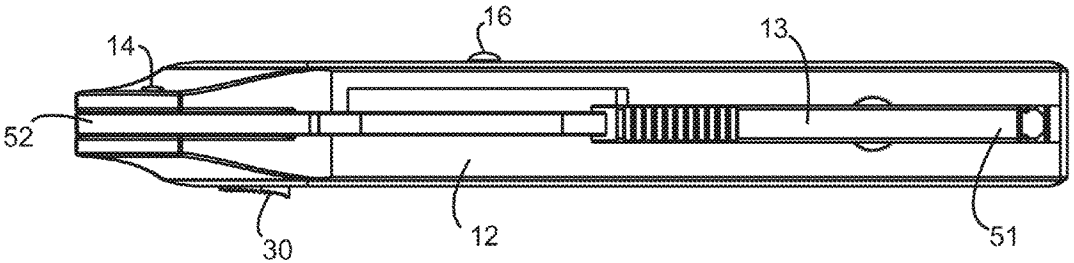
FIG. 1C shows a top perspective view of a straight razor with reloadable cartridge of the present invention.

FIGS. 1A, 1B and 1C show a perspective view of a straight razor 10 with reloadable cartridge 11 of the present invention. The straight razor 10 of the present invention comprises of a handle 12 having an elongated body; a blade holder 13 pivotally attached to the handle 12, and a reloadable cartridge 11.

Again as shown in FIGS. 1A, 1B and 1C, the handle has a handle-distal end 21 and a handle-proximal end 22 and the blade holder 13 has a holder-distal end 51 and a holder-proximal end 32. The holder-proximal end 32 is pivotally attached to the handle-proximal end 22. The straight razor 10 has a pivot point 14, where the blade holder 13 is pivotally attached to the handle 12. A slot 34 at the holder-proximal end 32 is sized and designed to receive the handle 12. The blade holder 12 can also move along the slot 34 based on a user's preference.

Again as shown in FIGS. 1A, 1B and 1C, a cartridge ejector button 16 is designed at a side wall 23 of the handle 12 to eject the cartridge 11 from the handle body 12. The user can push the cartridge ejector button 16 down to release the cartridge 11 from the handle body 12 to reload at least one blade.

Figure 2:
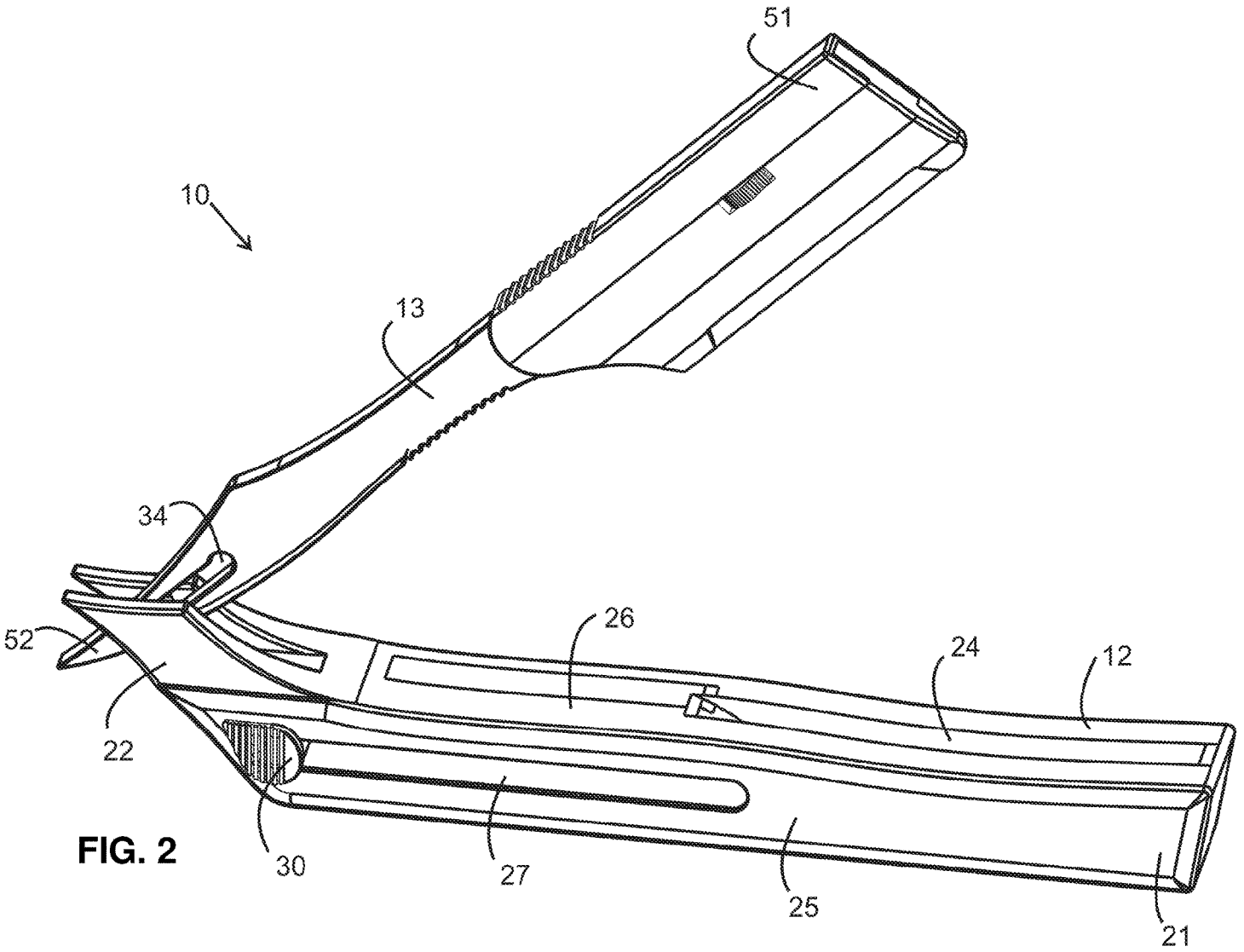
FIG. 2 shows a lateral perspective view of a straight razor of the present invention.

FIG. 2 shows a lateral perspective view of a straight razor 10 of the present invention. The blade holder 13 can pivotally be attached to the handle 12 from the holder-distal end 32. A handle-slot 24 is designed in a top portion 26 of the handle 12 to receive the blade holder 13. The handle-slot 24 is sized to receive the blade holder 13 in one specific way. The blade holder 13 is placed in the handle-slot 24 for loading a new blade from the cartridge, as shown in FIG. 1A.

Figure 3:
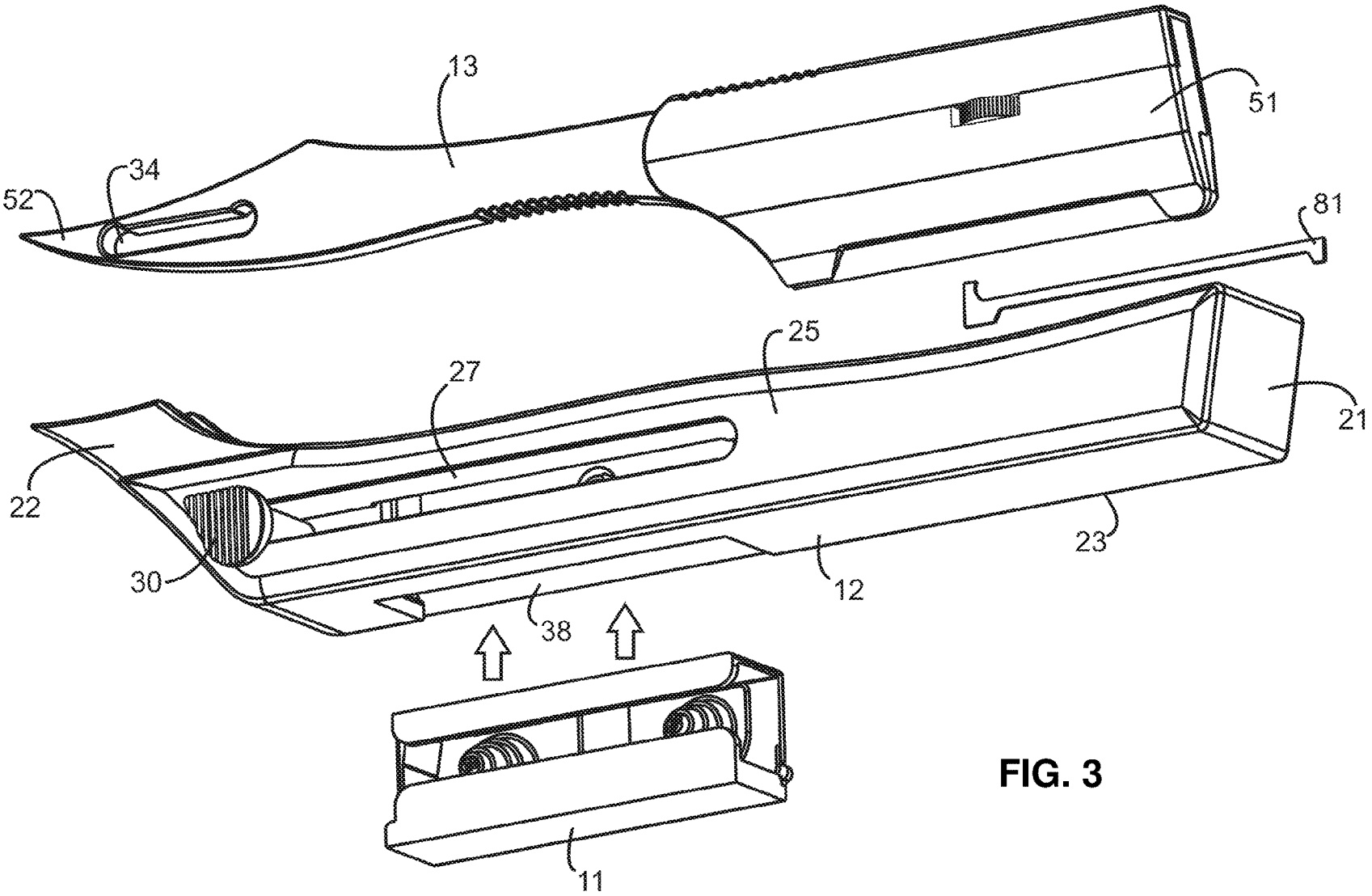
FIG. 3 shows a lateral perspective view of a handle, a blade holder and a cartridge of a of the present invention.

FIG. 3 shows a perspective view of the straight razor 10 with reloadable cartridge 11 of the present invention. The straight razor 10 of the present invention comprises of a handle 12; a blade holder 13, and a reloadable cartridge 11. The combination of these three elements provides consecutive replacement of blades without having to load each individual blade into the blade holder 13. The handle 12 has two side walls 23, 25. A groove 27 is designed in the side wall 25 of the handle 12 to navigate a charging-handle 30 along the groove 27. The charging-handle 30 engages with a new blade inside the cartridge 11 and pushes the new blade into the holder-distal end 51.

Figure 4:
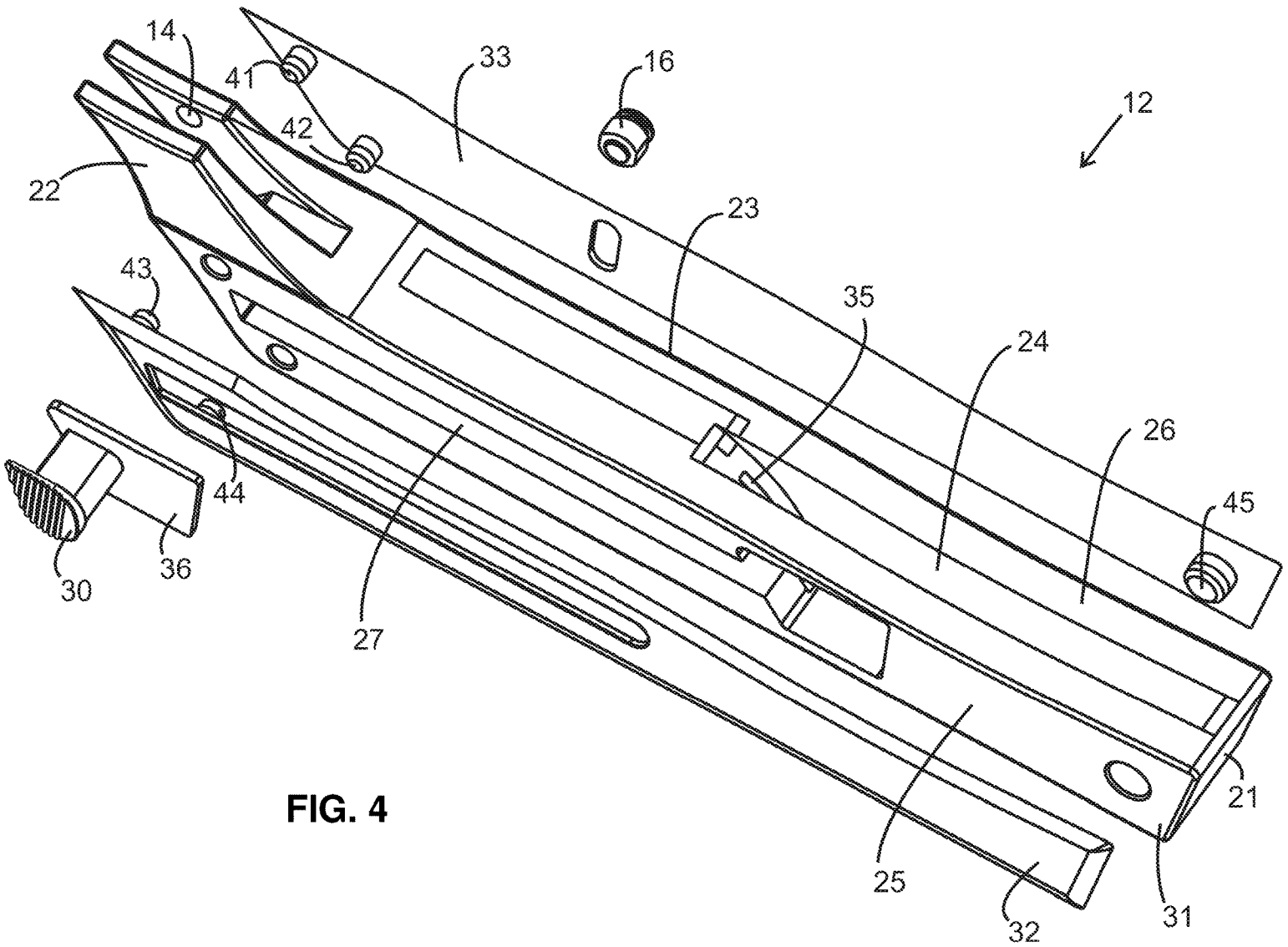
FIG. 4 shows an exploded view of the handle of the present invention.

FIG. 4 shows a perspective view of the handle 12 of the present invention. The handle 12 of the present invention comprises of a longitudinal body 31 having a top portion 26 with a longitudinal slot 24; two side walls 23, 25 with two covers 32-33; the cartridge ejector button 16; the charging-handle 30, and a groove 27 on a side wall 25. The charging-handle 30 navigates a new blade from the cartridge along a pathway 35 inside the body 31 to the longitudinal slot 24.

Again as shown in FIG. 4, a charging-handle 30 has a charging-plate 36 which is sized to receive a new blade from the cartridge and navigate the new blade along the pathway into the blade holder 13. The two covers 32-33 are attached to the side walls 23, 25 of the handle 12 by a plurality of pins 41-45. The user can load a new blade inside the blade holder 12 by pushing the charging-handle 30 along the groove 27 to the end.

Figure 5:
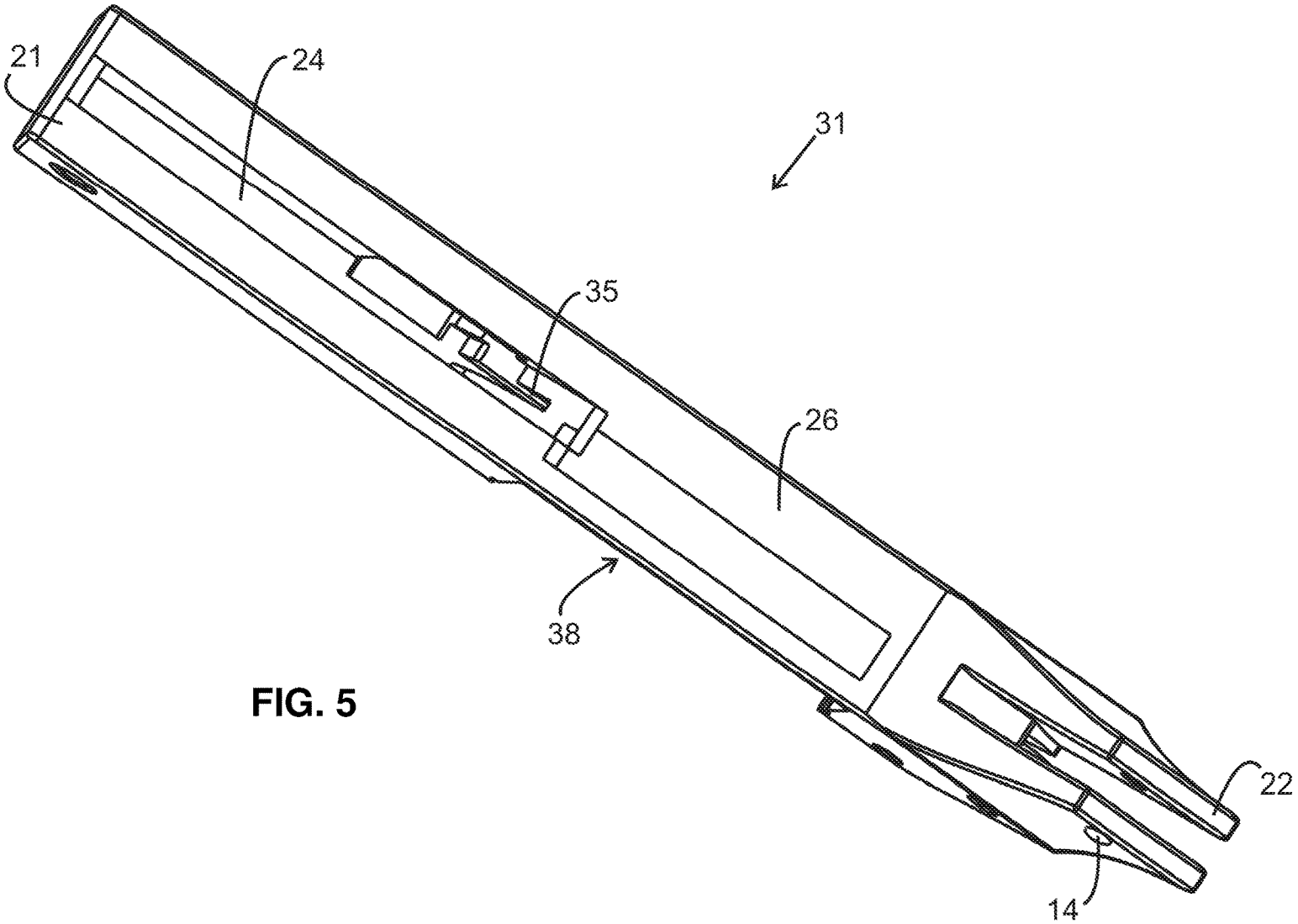
FIG. 5 shows a perspective view of the handle of the present invention.
Figure 6A:
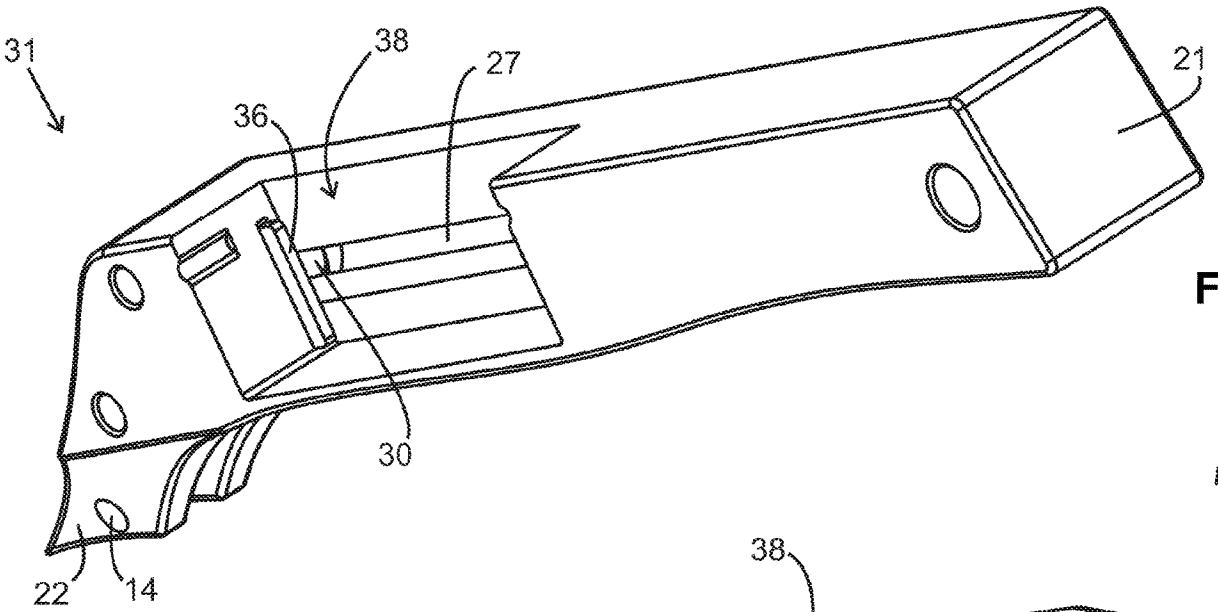
FIG. 6A shows a perspective view of the handle of the present invention.
Figure 6B:
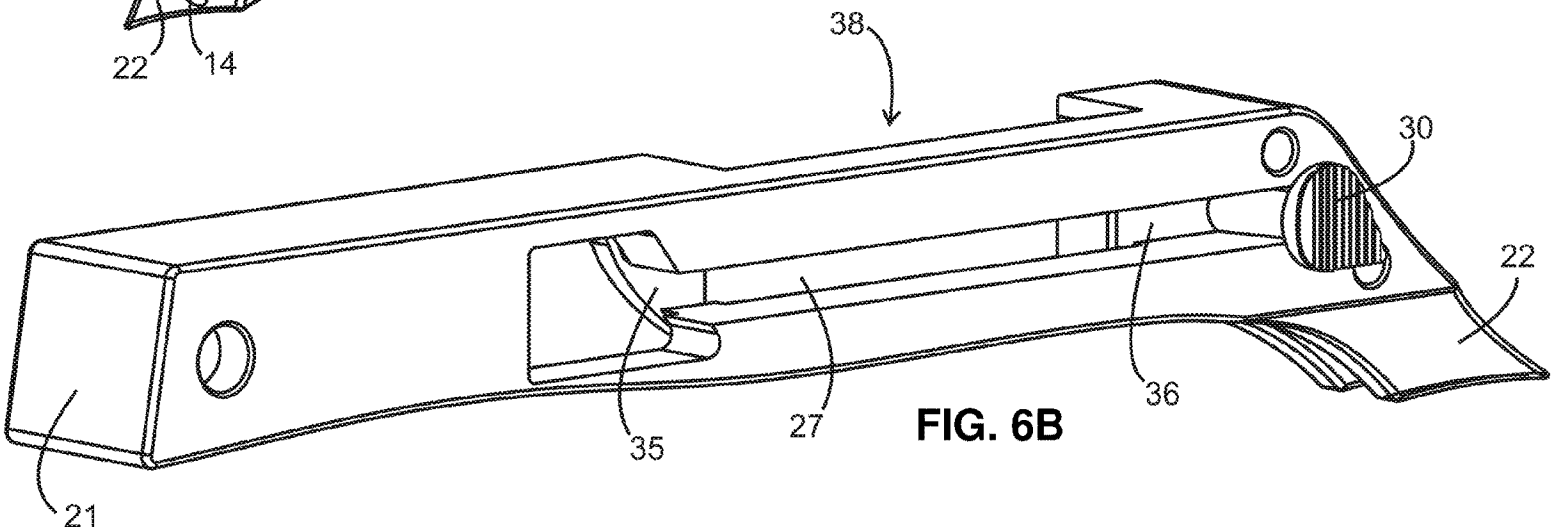
FIG. 6B shows a perspective view of the handle of the present invention.

FIGS. 5, 6A and 6B show a top perspective view of the handle 12 of the present invention. A new blade is navigated by the charging-handle 30 along the pathway 35 inside the body 31 to reach to the handle-slot 24. Again as shown in FIG. 5, an opening 38 is designed on a side wall 23 to receive a cartridge. The user can load a new blade inside the blade holder by pushing the charging-handle 30 along the groove 27 to the end.

Figure 7:
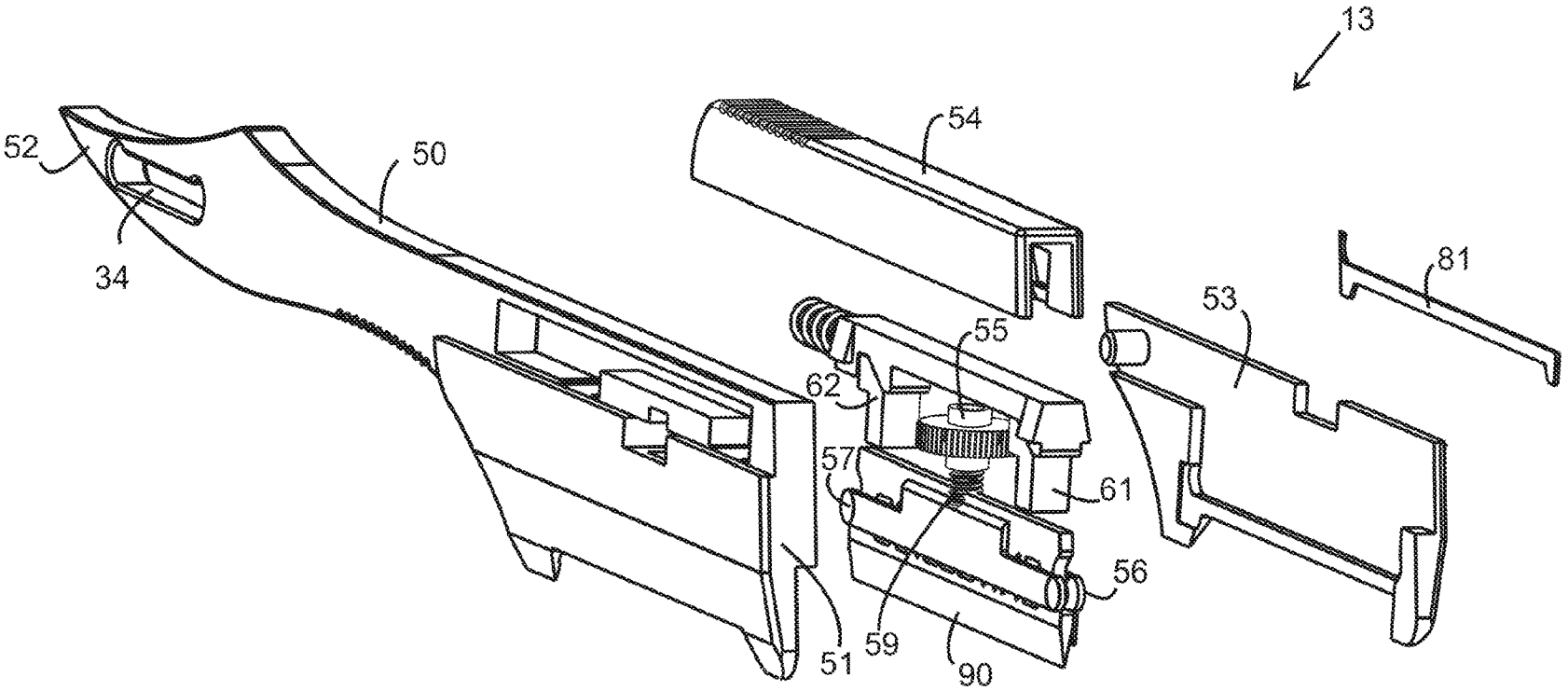
FIG. 7 shows an exploded view of the blade holder of the present invention.
Figure 8:
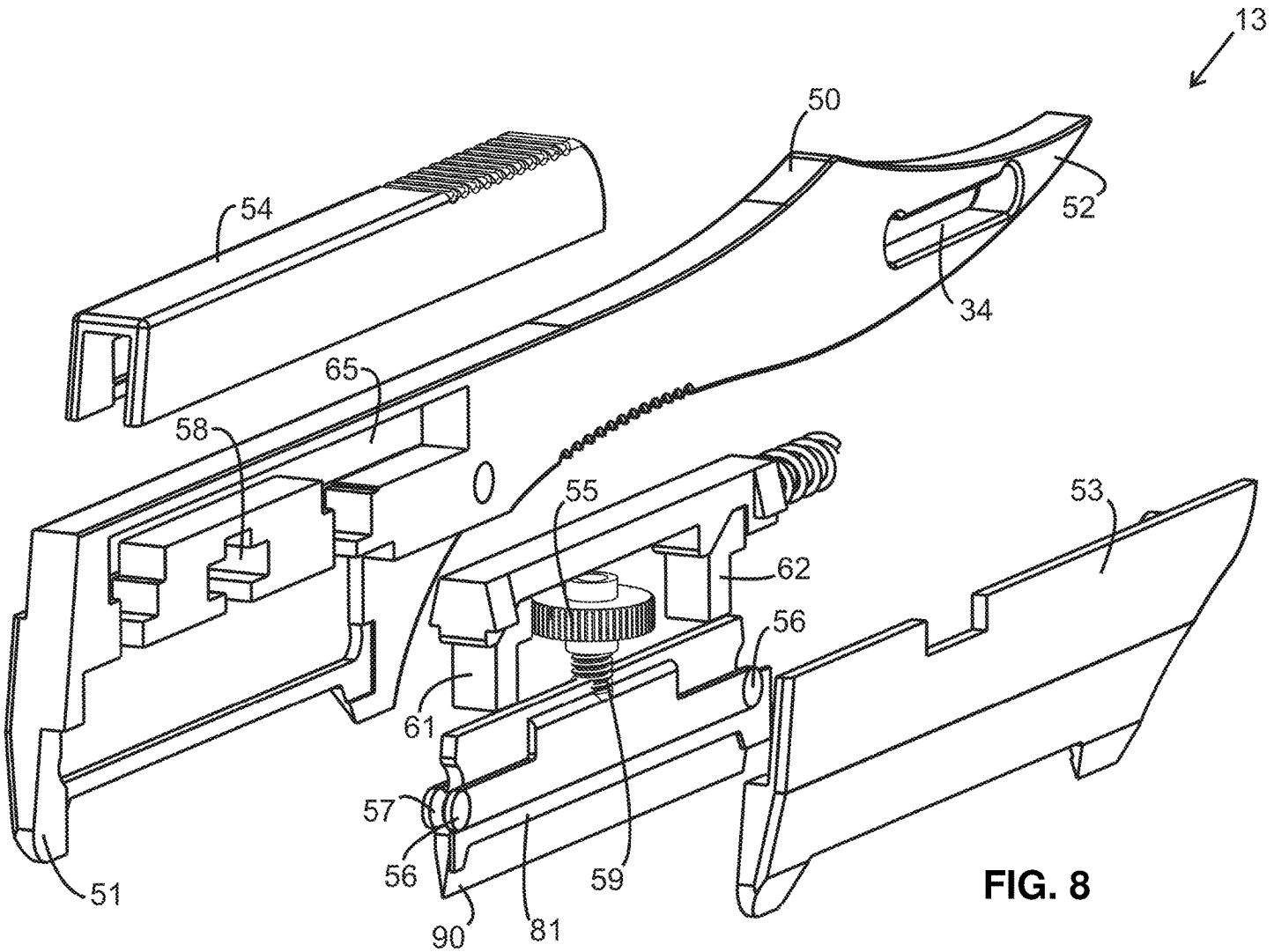
FIG. 8 shows an exploded view of the blade holder of the present invention.

FIGS. 7 and 8 show an exploded view of the blade holder 13 of the present invention. The blade holder 13 of the present invention comprises of an elongated body 50 having a holder-distal end 51 and a holder-proximal end 52; two clamp members 56-57 to grab a blade 90; a blade-cover 53; a top-cover 54, and a dial 55 to adjust the height of the blade 90.

Again as shown in FIGS. 7-8, an opening 58 on the holder-distal end 51 is designed to receive the dial 55 of the present invention. Two clamp members 56-57 are designed in such a way to be aligned by the pathway 35 on the handle 12. The charging-handle pushes the blade 90 between two clamp members 56-57. The two clamp members 56-57 securely and tightly hold a blade during the shaving operation. Two clamp members 56-57 have a spring characteristic which holds the blade 90 in the place. The dial 55 of the present invention is attached to a screw 59, which moves the clamp members 56-57 and the blade 90 vertically. The user can adjust the height of the blade 90 (the part of the blade, which is exposed to the skin) for more detailed shave.

Again as shown in FIGS. 7-8, the blade-cover 53 with the holder body 50 cover the clamp members 56-57 and the blade 90 so the edges of the blade 90 are not exposed to the skin of the user. The clamp members 56-57 are secured from the top by two vertical members 61-62, which are placed inside the holder body 50 in an opening 65, which is sized to receive them 61-62. Two vertical members 61-62 prevent the vertical movement of the blade 90.

Again as shown in FIG. 8, a head of the blade has an ejection slider 81 that releases the soiled blade when the shaving is finished. The user can remove the used blade by the ejection slider 81, which is placed along the length of the blade.

Figure 9:
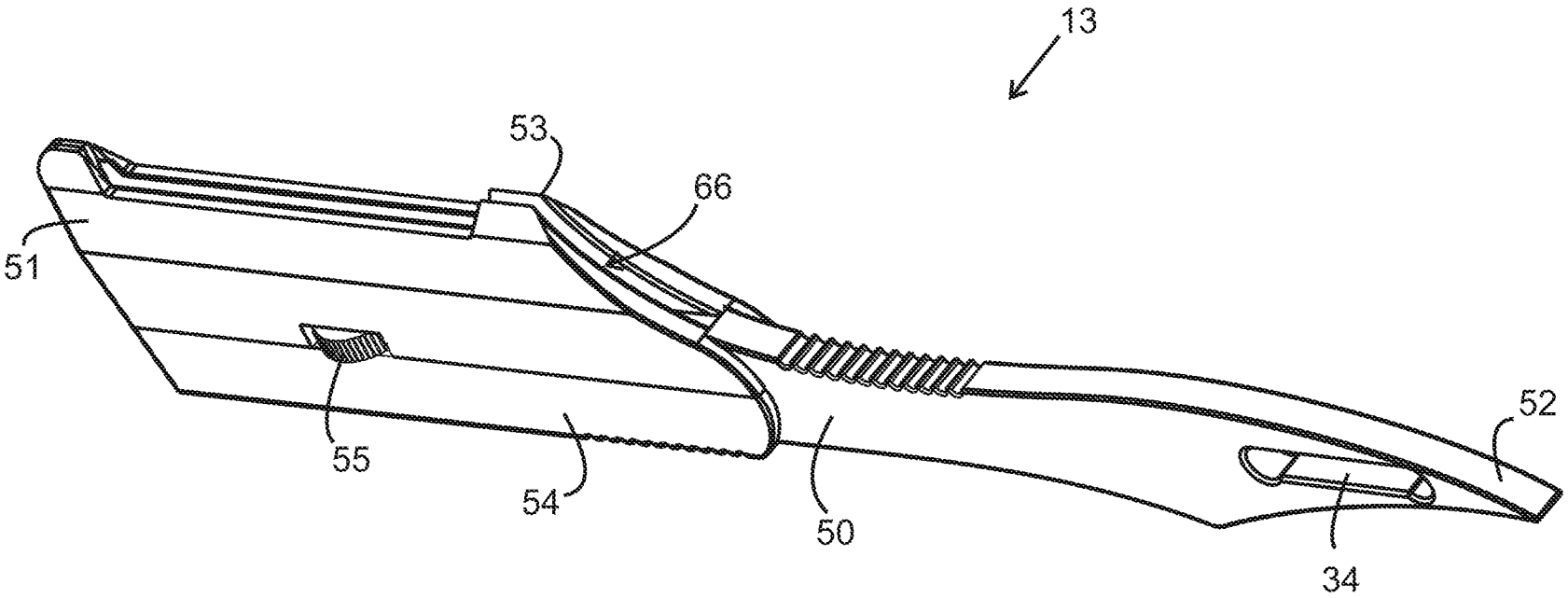
FIG. 9 shows a perspective view of the blade holder of the present invention.

As shown in FIGS. 4 and 9, a charging-handle 30 has a charging-plate 36, which is sized to receive a new blade from the cartridge and navigate the new blade along the pathway 35 into a blade-slot 66 on the blade holder 13. The blade-slot 66 is aligned with two clamp members 56-57 so the charging-handle 30 pushes the new blade between two clamp members. FIG. 9 shows the blade holder 13 of the present invention without a blade.

Figure 10B:
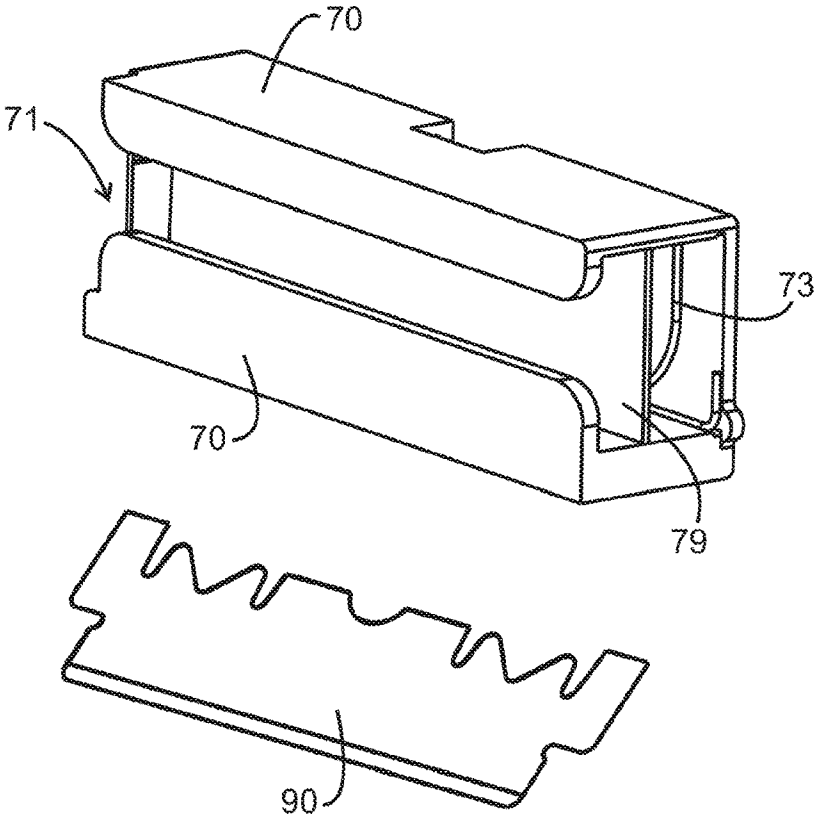
FIG. 10B shows a perspective view of the cartridge of the present invention.
Figure 10A:
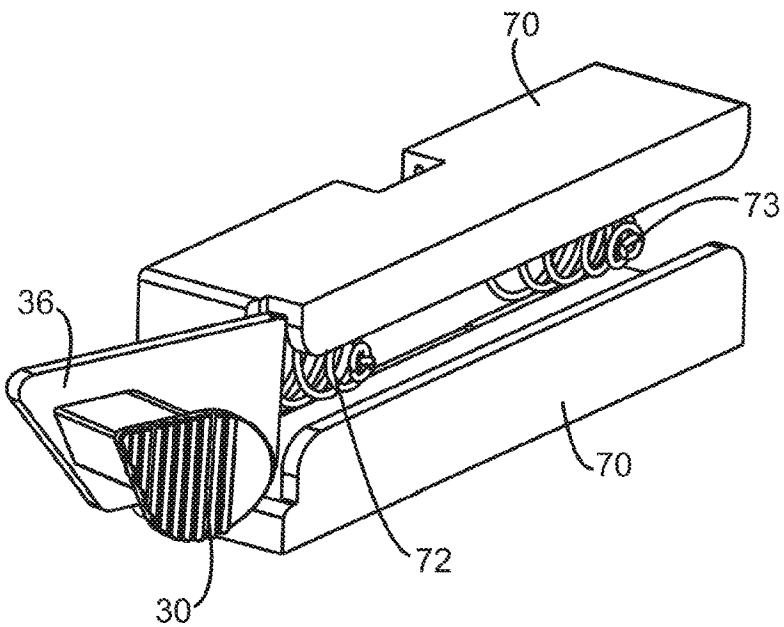
FIG. 10A shows a perspective view of the cartridge of the present invention.
Figure 11C:
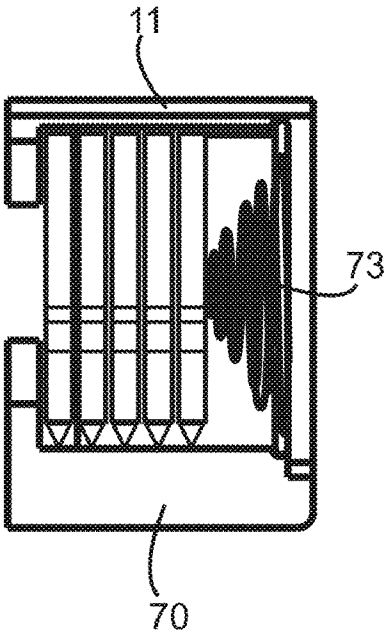
FIG. 11C shows a front view of the cartridge of the present invention.
Figure 11B:
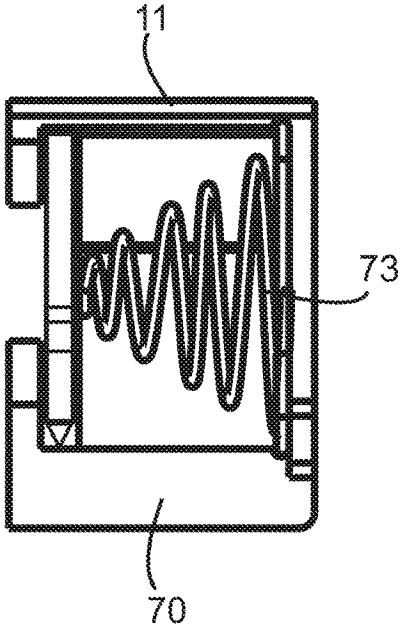
FIG. 11B shows a front view of the cartridge of the present invention.
Figure 11A:
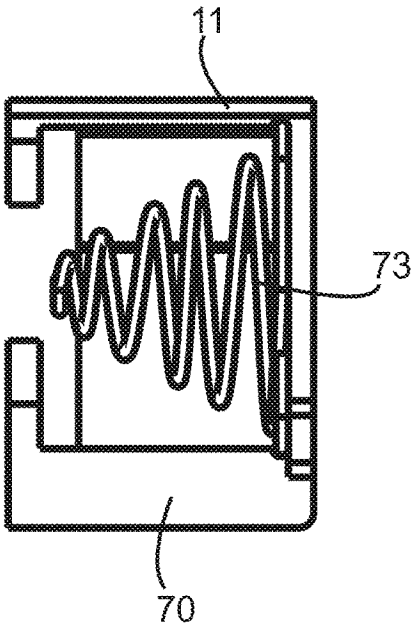
FIG. 11A shows a front view of the cartridge of the present invention.
Figure 11A:
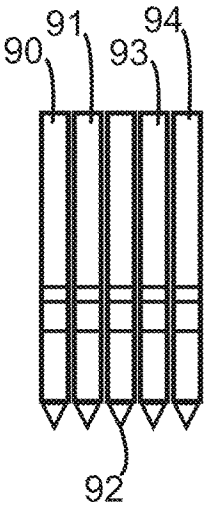

As shown in FIGS. 10A and 10B the cartridge 11 of the present invention comprises of a cartridge-enclosure 70 having at least one spring 72, 73 designed inside the cartridge-enclosure 70 to push a plurality of blades 90-94 toward a cartridge-opening 71. To distribute the spring force along the whole part of the blades, a plate 79 can be mounted on one end of the springs 72-73.

FIG. 10A shows a perspective view of the cartridge 11 and the charging-handle 30 of the present invention. As shown in FIGS. 10A, 10B, 11A, 11B and 11C, the charging-plate 36 is sized to pass through the cartridge-opening 71 to engage with one blade inside the cartridge 11. As shown in FIG. 10B, the blade 90 is single edge blade.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A straight razor used in a barber shop for housing a plurality of blades, comprising:

a) a handle having a handle-distal end and a handle-proximal end, wherein said handle comprises of a longitudinal body with a longitudinal slot at a top portion of said longitudinal body; a groove along a wall side of said longitudinal body to navigate a charging-handle to a pathway;

b) a blade holder wherein said blade holder places inside said longitudinal slot, said blade holder is pivotally attached to said handle from said handle-proximal end, said blade holder comprises of an elongated body with two clamp members designed at a holder-distal end to grab a blade;

c) a reloadable cartridge having a cartridge-enclosure with a plurality of springs attached inside said cartridge-enclosure to push a plurality of blades toward a cartridge opening, whereby for reloading a new blade from the blades inside said reloadable cartridge, a user pushes the charging-handle along said groove, the charging-handle engages with said new blade and moves the new blade from said reloadable cartridge toward said longitudinal slot and in between said two clamp members.

2. The straight razor of claim 1, wherein said handle further has a cartridge ejector button to release said reloadable cartridge from said longitudinal body.

3. The straight razor of claim 1, wherein said blade holder further has a dial equipped with a screw to adjust the height of said two clamp members and said new blade.

4. The straight razor of claim 1, wherein said charging-handle comprises of a handle with a charging-plate, wherein said charging plate has an engaging portion sized to receive a width of said new blade.

5. The straight razor of claim 1, wherein said blade holder further has a blade-slot, wherein said blade-slot aligns with said groove and said pathway.

6. The straight razor of claim 1, wherein said reloadable cartridge further has a distribution-plate to distribute a spring force.

7. The straight razor of claim 1, wherein said blade holder further has an ejection slider to release a used blade when the shaving is finished.

* * * * *